US006408672B1

(12) United States Patent
Roe et al.

(10) Patent No.: US 6,408,672 B1
(45) Date of Patent: Jun. 25, 2002

(54) PROCESS FOR COLD FORMING TUBE ENDS

(75) Inventors: Derek Vernon Roe, Woodstock; Ovidiu I. Savescu, Cambridge, both of (CA)

(73) Assignee: Copperweld Canada Inc. (CA)

( * ) Notice: Subject to any disclaimer, the term of this patent is extended or adjusted under 35 U.S.C. 154(b) by 0 days.

(21) Appl. No.: 09/511,938

(22) Filed: Feb. 24, 2000

(30) Foreign Application Priority Data

Feb. 24, 1999 (CA) ..... 2262777

(51) Int. Cl.[7] ..... B21D 19/12

(52) U.S. Cl. ..... 72/370.11; 72/370.03; 72/359; 72/318

(58) Field of Search ..... 72/318, 370.03, 72/370.1, 370.11, 370.13, 370.15, 377, 359

(56) References Cited

U.S. PATENT DOCUMENTS

| | | | | | |
|---|---|---|---|---|---|
| 155,128 | A | * | 9/1874 | Ward | 72/359 |
| 1,046,138 | A | * | 12/1912 | Babbitt | 72/359 |
| 1,966,053 | A | * | 7/1934 | Squires | 72/359 |
| 2,227,820 | A | * | 1/1941 | Bratz | 72/318 |
| 4,213,322 | A | | 7/1980 | Barnes, Jr. | 72/357 |
| 4,845,972 | A | | 7/1989 | Takeuchi et al. | 72/370 |
| 5,090,611 | A | * | 2/1992 | Takikawa | 72/357 |
| 5,184,495 | A | * | 2/1993 | Chunn | 72/318 |
| 5,203,194 | A | | 4/1993 | Marquardt | 72/316 |
| 5,956,988 | A | * | 9/1999 | Beste | 72/370.03 |

FOREIGN PATENT DOCUMENTS

| | | | | |
|---|---|---|---|---|
| DE | 439258 | * | 1/1927 | 72/359 |
| DE | 559902 | * | 9/1932 | 72/359 |
| GB | 5481 | * | of 1891 | 72/359 |
| JP | 127535 | * | 8/1982 | 72/359 |

* cited by examiner

*Primary Examiner*—Daniel C. Crane
(74) *Attorney, Agent, or Firm*—Michael L. Kenaga; Piper Marbury Rudnick & Wolfe

(57) ABSTRACT

A process for cold forming the ends of metal tubes to reinforce same includes a die cavity into which the tube is placed. The die cavity includes a section with a recess having a greater diameter than the tube. The tube is placed such that a portion is left outside of the cavity and a mandrel is inserted into the tube. The mandrel includes a section that is adapted to bear against the portion of the tube outside of the cavity and to deform same. The deformation process results in the tube being folded upon itself within the recess in the cavity thereby forming a reinforcing flange at the end of the tube. The process is conducted without heating the tube.

5 Claims, 2 Drawing Sheets

P
28
32
26
34
36
38
40
41
42
44
46

PROCESS FOR COLD FORMING TUBE ENDS

BACKGROUND OF THE INVENTION

1. Field of the Invention

The present invention relates to processes for deforming metal tubes. More specifically, the invention relates to a process for cold forming an end of a pipe to provide a reinforced portion.

2. Description of the Prior Art

In the automotive industry, vehicles are often fitted with a hitch assembly to which a trailer may be attached. Such assembly usually includes a hitch receiver tube and a hitch bar slidably engaged within same. The hitch bar includes a ball onto which the trailer is attached. The hitch receiver tube is mounted on the vehicle frame by a suitable means such as brackets and the like and is normally provided at its terminal end (i.e. the end into which the hitch bar inserted) with a reinforcing collar. Although such collar increases the strength of the end of the tube, various problems have been found with this structure. For example, the reinforcing collar must be welded on the bar thereby reducing its aesthetic qualities. Further, since a complete seal is not possible, the accumulation of water and salt within any spaces accelerates the corrosion of the entire structure.

Various solutions have been proposed to address the above issue. One example is described by Marquardt in U.S. Pat. No. 5,203,194. Marquardt teaches a process for reinforcing the terminal end of a hitch receiver tube wherein the wall thickness at the end is increased in a forming process. In this reference, the tube is heated to approximately 1800° F. and then placed within a die cavity having a flared region adjacent to the tube's terminal end. A mandrel is then inserted into the die and used to apply pressure to the tube's terminal end. This forces the tube material into the flared region thereby increasing the thickness of the tube at its end. This reference essentially teaches a forging process.

Although this reference provides a hitch receiver tube with the required reinforcement and which may overcome the problems mentioned above, there are still some deficiencies in the disclosed process. The main disadvantage with the Marquardt process lies in the requirement for heating the tube prior to the forming stage. As will be appreciated, such heating greatly increases the time a cost of producing each tube. Further, the heating of the tube results in carburization of its outer surface. The deposits resulting from the carburization must then be removed thereby further increasing the tube production time. In addition, the heating of the tube deteriorates its structural integrity thereby resulting in weakness.

Other references dealing with tube end forming processes include U.S. Pat. Nos. 4,845,972 and 4,213,322. However, these references all teach the heating of the tube prior to forming.

Thus, there is a need for a receiver tube forming process that overcomes the deficiencies in the known methods.

SUMMARY OF THE INVENTION

Thus, the present invention provides, in one embodiment, a process for reinforcing the end of a metal tube having inner and outer surfaces and first and second ends, the process comprising the steps of:

a) providing a die having first and second ends and defining a cavity conforming to the outer surface of the tube, the cavity having a recess at the first end that is wider than the tube;

b) placing the tube in the die cavity such wherein the tube first end extends out of the die cavity beyond the die first end;

c) providing a means for preventing movement of the tube longitudinally with respect to the die cavity;

d) providing a mandrel having a first portion adapted to fit within the tube through the tube first end, the mandrel also having second portion with a tube deforming surface adapted to impinge upon the tube first end;

e) inserting the mandrel first portion into the first end of the tube until the tube deforming surface contacts the first end of the tube;

f) advancing the mandrel under pressure thereby causing deformation of the first end of the tube and folding of same into the recess of the die cavity.

The invention also provides a tube having a first end wherein the first end includes a radially extending reinforced portion comprising a section of the tube folded upon itself.

BRIEF DESCRIPTION OF THE DRAWINGS

These and other features of the preferred embodiments of the invention will become more apparent in the following detailed description in which reference is made to the appended drawings wherein.

DESCRIPTION OF THE PREFERRED EMBODIMENTS

Figure 1:
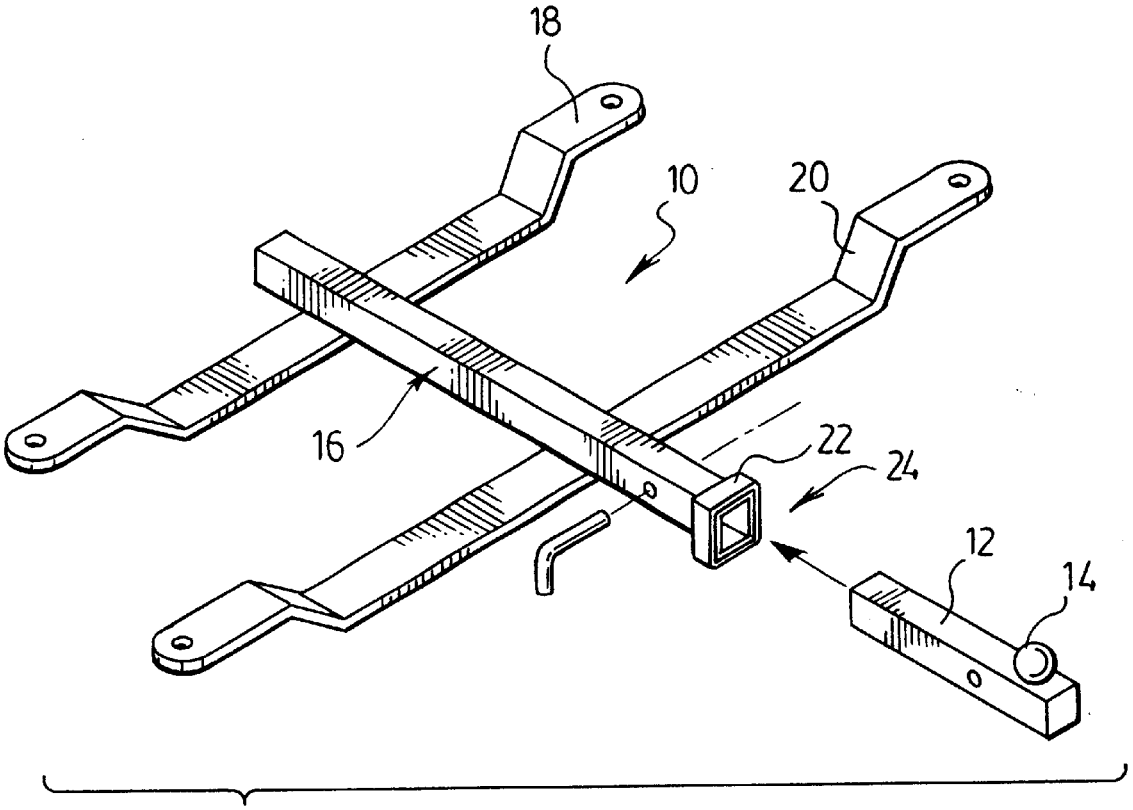
FIG. 1. (PRIOR ART)
FIG. 1 is a perspective view of a trailer hitch assembly as known in the art.

As shown in FIG. 1, a trailer hitch assembly is shown generally at 10. The assembly includes a hitch bar 12 having a ball 14 onto which a trailer (not shown) is attached. The hitch bar 12 is sized for insertion into a hitch receiver tube 16. The receiver tube 16 is secured to a vehicle body (not shown) by conventional means such as, for example, brackets 18 and 20, which are attached to the vehicle. The receiver tube is provided with a reinforcing collar 22, which is normally welded onto a terminal end 24 of the receiver tube.

Figure 2:
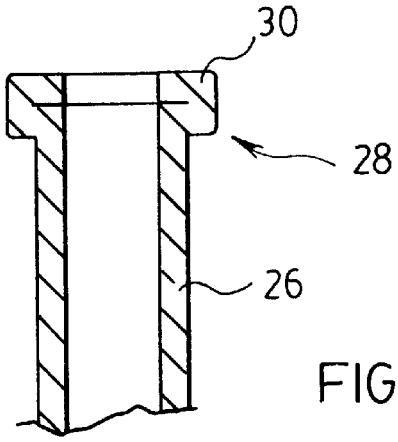
FIG. 2 is a side view of a hitch receiver tube as formed by the process of the present invention.

FIG. 2 illustrates a receiver tube 26 with a terminal end 28 as formed according to the process of the present invention. As indicated previously, the terminal end comprises the end of the receiver tube into which the hitch bar is inserted. As shown, the terminal end 28 of the receiver tube 16 is reinforced with an end portion 30, which comprises a folded portion of the receiver tube.

Figures 3A, 3B, 3C, 3D, 4A, 4B, 4C, 4D:
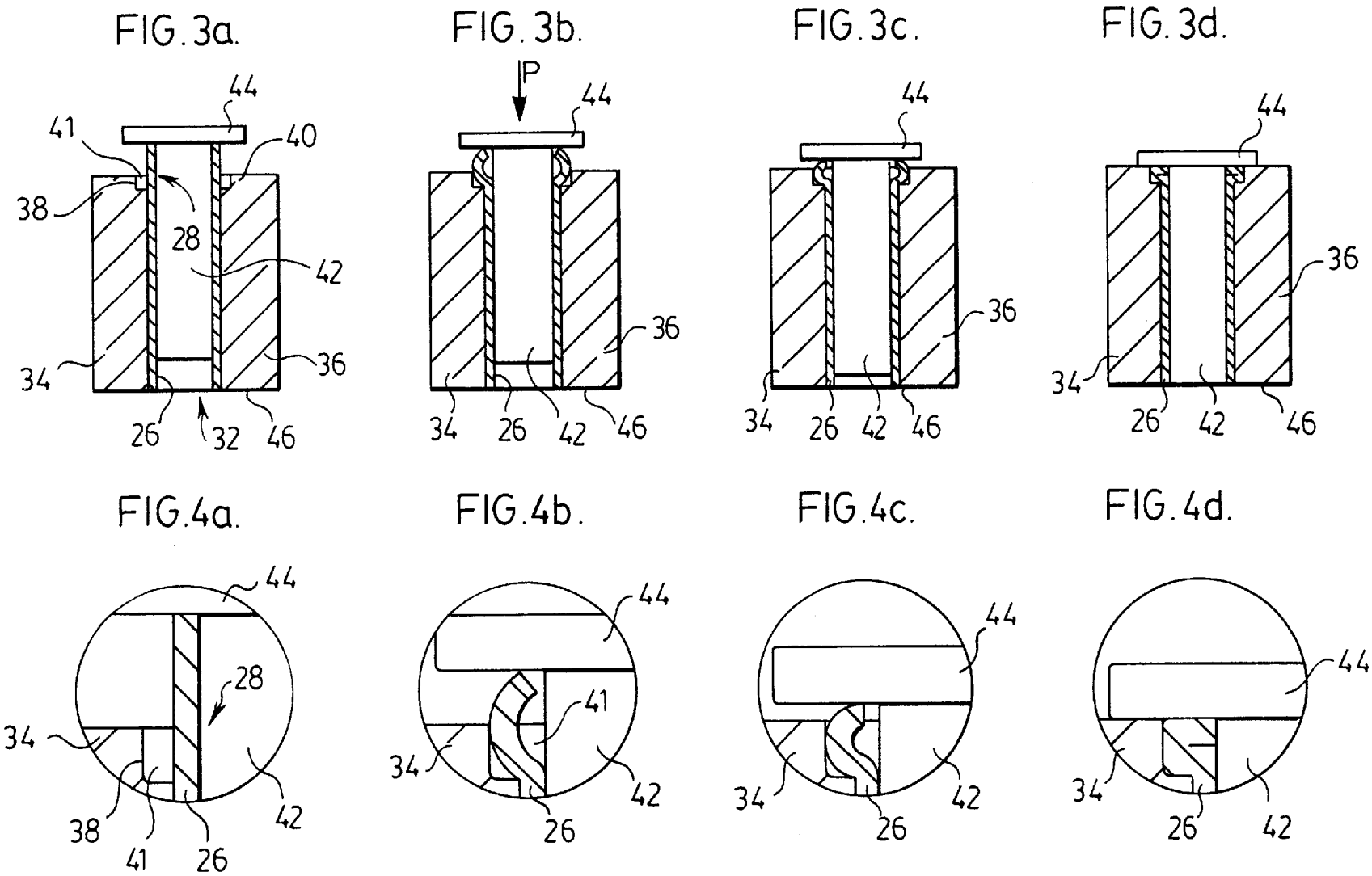
FIGS. 3*a* to 3*d* are side cross sectional views of the apparatus for the process of the present invention.
FIGS. 4*a* to 4*d* are partial side cross sectional views of the apparatus of FIGS. 3*a* to 3*d* illustrating the deformation of the hitch receiver tube in detail.

The invention will now be described with reference to FIGS. 3*a* to 3*d* and 4*a* to 4*d*, which illustrate the various stages of the process. The first step of the process, as shown in FIGS. 3*a* and 4*a*, involves the placement of a receiver tube 26 into a die cavity 32 formed by die halves 34 and 36. Each of the die halves includes a recess 38 and 40, respectively. Recesses 38 and 40 combine to provide a recess, or void space 41 in the die cavity 32. The void space preferably extends radially and equidistantly from the rest of the cavity so as to form a ring. As shown, the receiver tube 26 is placed in the die cavity such that a portion of the terminal end 28 is clear of the cavity 32. The purpose for placing the terminal end outside of the cavity will become clear in the following description. Next, a mandrel 42 is inserted into the tube. The mandrel includes a force-applying flange 44, which is of a greater diameter than the tube 26. The assembly also includes a stop 46 that prevents the tube 26 from moving in relation to the die.

As shown in FIGS. 3*b* and 4*b*, the mandrel is then forced against the receiver tube 26 in the direction indicated by P. The flange 44 of the mandrel 42 imparts pressure against the tube 26 and, in particular, against the terminal end 28. This force causes buckling of the tube material. Since the mandrel 42 is inserted within the tube 26, the tube material is deformed radially outward into the void space 41.

FIGS. 3*c* and 4*c* illustrate the next step in the process wherein the pressure applied by the flange 44 is continued, thereby causing the tube material to fold upon itself within the void space 41.

In the final stage, as shown in FIGS. 3*d* and 4*d*, the mandrel 42 and flange 44 are advanced until the flange contacts the die halves 34 and 36. At this point, the tube material has completely folded upon itself and occupies the void space 41.

As mentioned above, when the tube is placed in the die cavity, the end portion of the terminal end is left outside of the cavity. This portion becomes folded during the above process to form the reinforced section. It will be understood that that the length of tube left outside of the cavity will depend upon the thickness of the tube as well as the dimensions of the void space in the cavity. For example, in order to determine the length of tube to remain outside of the die cavity, the volume of the void space, or recess, 41 is first calculated. Next, the thickness of the tube material is measured. Since the tube material left outside of the cavity is to occupy the void space, the volume of material should equal that of the void space. Therefore, since the thickness of the material is known, the length of tube needed to fill the void space can easily be calculated. In the preferred case, an empirical adjustment is made to account for compression of the material etc.

Thus, the present invention provides a process for cold forming the ends of tubes so as to provide a reinforced portion. By omitting the need for heating the tube prior to the forming step, the various problems discussed previously are avoided. One of the advantages of the invention lies in the reduction in production costs associated with removing the requirement for heating the tube. The cycle time for producing the tubes is also reduced by removing the need for heating and, subsequently, cooling the tubes and for removing the deposits of any carburization that may take place. Further, the metal forming the tube is not weakened due to any molecular effects resulting from the heating step.

The present invention is can be used with tubes of either rectangular or circular cross sections.

Although the invention has been described with reference to certain specific embodiments, various modifications thereof will be apparent to those skilled in the art without departing from the spirit and scope of the invention as outlined in the claims appended hereto.

The embodiments of the invention in which an exclusive property or privilege is claimed are defined as follows:

1. A process for reinforcing, an end of a metal tube having inner and outer surfaces and first and second ends, the process comprising the steps of:

a) providing a die having first and second ends and defining a cavity conforming to the outer surface of said tube, the cavity having a recess at said first end that is wider than the tube;

b) placing the tube in said die cavity such that said tube first end extends out of said die cavity and out of said recess beyond said die first end;

c) providing a means for preventing movement of the tube longitudinally with respect to said die cavity;

d) providing a mandrel having a first portion adapted to fit within said tube through said tube first end, the mandrel also having a second portion with a tube deforming surface adapted to impinge upon said tube first end;

e) inserting said mandrel first portion into the first end of said tube until the tube deforming surface contacts the first end of the tube;

f) advancing the mandrel under pressure thereby causing cold deformation of the first end of the tube and folding of same into the recess of said die cavity.

2. The process of claim 1 wherein said mandrel first portion conforms to the inner surface of the tube.

3. The process of claim 1 wherein said means for preventing movement of the tube comprises a barrier.

4. The process of claim 1 wherein said tube has a circular or rectangular cross section.

5. The process of claim 1 wherein the tube comprises a hitch bar receiver tube.

* * * * *